US008132373B2

(12) United States Patent
Radzat et al.

(10) Patent No.: US 8,132,373 B2
(45) Date of Patent: Mar. 13, 2012

(54) MODULAR BUILDING PANEL HANGING SYSTEM

(76) Inventors: Gary F. Radzat, Sebastopol, CA (US); Gregory Lynn Koepf, Moraga, CA (US)

( * ) Notice: Subject to any disclaimer, the term of this patent is extended or adjusted under 35 U.S.C. 154(b) by 0 days.

(21) Appl. No.: 12/647,436

(22) Filed: Dec. 25, 2009

(65) Prior Publication Data

US 2010/0162647 A1 Jul. 1, 2010

Related U.S. Application Data

(60) Provisional application No. 61/140,934, filed on Dec. 27, 2008.

(51) Int. Cl.

| | |
|---|---|
| ***E04C 2/54*** | (2006.01) |
| ***E02D 35/00*** | (2006.01) |
| ***E04G 21/14*** | (2006.01) |
| ***E04H 12/34*** | (2006.01) |
| ***E04B 2/00*** | (2006.01) |

(52) U.S. Cl. ..... 52/125.2; 52/122.1; 52/125.4; 52/125.5; 52/125.6; 52/582.1; 52/506.05; 52/787.1

(58) Field of Classification Search ..... 52/122.1, 52/125.2, 125.4, 125.5, 125.6, 309.1, 582.1, 52/506.05, 787.1

See application file for complete search history.

(56) References Cited

U.S. PATENT DOCUMENTS

| | | | | | |
|---|---|---|---|---|---|
| 1,360,200 | A | * | 11/1920 | Dowd | 411/342 |
| 2,876,053 | A | * | 3/1959 | Eves | 52/787.1 |
| 3,564,798 | A | * | 2/1971 | Darby et al. | 52/787.1 |
| 3,977,643 | A | * | 8/1976 | Staley | 248/339 |
| 4,099,694 | A | * | 7/1978 | Horwitz | 248/339 |
| 4,127,252 | A | * | 11/1978 | Splawn | 248/333 |
| 4,139,972 | A | | 2/1979 | Naka | |
| 4,452,360 | A | | 6/1984 | Barnes | |
| 4,724,967 | A | | 2/1988 | Valiulis | |
| 4,728,068 | A | | 3/1988 | Rivkin | |
| 4,805,855 | A | * | 2/1989 | Kirby | 248/58 |
| 4,843,789 | A | | 7/1989 | Naka | |
| 4,850,557 | A | | 7/1989 | Valiulis | |
| 4,943,016 | A | | 7/1990 | Hennecke | |
| 5,147,166 | A | | 9/1992 | Harker | |
| D330,672 | S | | 11/1992 | Wilkinson, III | |
| 5,209,621 | A | * | 5/1993 | Burbidge | 411/340 |
| 5,480,116 | A | | 1/1996 | Callas | |
| 5,702,218 | A | | 12/1997 | Onofrio | |
| 5,816,557 | A | | 10/1998 | Tepper | |
| D446,110 | S | | 8/2001 | McDuff | |
| 6,295,036 | B1 | | 9/2001 | Mata et al. | |
| 6,511,522 | B1 | * | 1/2003 | Gomez et al. | 55/385.2 |
| 6,564,521 | B1 | * | 5/2003 | Brown et al. | 52/309.11 |
| 6,601,361 | B2 | | 8/2003 | Seibert | |
| 6,644,483 | B1 | | 11/2003 | Lai | |
| 6,725,608 | B1 | | 4/2004 | Kraus | |
| 7,082,664 | B2 | | 8/2006 | Powers et al. | |
| 7,243,891 | B2 | | 7/2007 | Wu et al. | |
| 7,296,499 | B2 | | 11/2007 | Bodin et al. | |
| 7,297,022 | B2 | | 11/2007 | Pearce | |
| 7,325,776 | B2 | | 2/2008 | Shibuya | |
| 7,410,140 | B2 | | 8/2008 | Hartwick | |

(Continued)

*Primary Examiner* — Mark Wendell
(74) *Attorney, Agent, or Firm* — Frank M. Washko

(57) ABSTRACT

A system for hanging items from a modular building panel is disclosed. One embodiment of the system includes a modular building panel with a hole in the panel, a hanging member, with a load distribution plate, and an attachment shaft, and an attachment means at the end of the attachment shaft. Several embodiments of the present invention are described.

7 Claims, 3 Drawing Sheets

U.S. PATENT DOCUMENTS

| | | | | |
|---|---|---|---|---|
| D580,747 | S | 11/2008 | Pollak et al. | |
| 2006/0137294 | A1* | 6/2006 | Waits Jr. et al. | 52/787.1 |
| 2006/0254190 | A1* | 11/2006 | Hunt | 52/698 |
| 2008/0149769 | A1* | 6/2008 | Koch et al. | 244/121 |
| 2009/0129886 | A1* | 5/2009 | Gelb et al. | 411/372.5 |
| 2010/0037547 | A1* | 2/2010 | Taraba et al. | 52/289 |

* cited by examiner

MODULAR BUILDING PANEL HANGING SYSTEM

CROSS-REFERENCE TO RELATED APPLICATION

This application claims priority benefit of U.S. Provisional Patent Application No. 61/140,934, entitled "Modular Building Panel Hanging System," filed Dec. 27, 2008. The disclosure in that application is incorporated herein in its entirety.

BACKGROUND AND SUMMARY

The present invention relates generally to modular building panels, and more particularly, to hanging systems used with building panels.

Modular building panels are used to construct building structures when time, cost, or convenience is a priority. Manufacturers of such buildings have developed methods to easily attach building panels together to form the walls of structures. This allows builders to quickly construct a building to meet a customer's needs. Modular building panels have features and characteristics that allow them to be assembled into a final structure relatively quickly and easily.

Currently, there is no solution known to easily and modularly attach utility routings within the panels of completed modular structures. Items such as: water pipes, gas lines, electrical conduit, network cables, sewer lines, and similar routings, are typically routed and hung throughout the structure in the similar ways used for traditional buildings. These methods fail to capitalize on the priorities of modular building systems. The methods may not be quick, low cost, nor modular. Moreover, they may be permanent and inconvenient to disassemble. At times, they may be attached to the modular structure in ad hoc ways that are detrimental to the integrity of the modular structure or building panels themselves.

The present invention addresses the problems of using traditional utility routing attachment methods. A modular building panel attachment system is disclosed that attaches to a building panel. This attachment may provide not only an attachment point for a utility routing, but it may also provide a load-distributing design to minimize potential damage to the building panel due to the weight of one or more hanging utility routings. Particular concerns addressed by the load-distributing plate are: pull-through, indentation, permanent deformation, stress fracture, or any other forms of damage. For example, an attachment stud may be designed to protrude through both sides of the ceiling building panel. On one side of the attachment stud, a load distribution plate may be attached to distribute a hanging load over the surface of the panel. On the opposite side, a means for attaching a water pipe to the attachment stud may be provided. This would allow a pipe to be hung from an existing attachment stud in a building panel while the attachment is secured to the panel via a load distribution device.

In an exemplary embodiment of the modular building panel attachment system, the attachment stud may be a secured to the building panel using a threaded attachment on the underside protrusion of the stud, at the intersection of the stud and the panel. The load distribution device on the top side of the panel may be a load plate attached to the top of the attachment stud. At the lower extremity of the attachment stud, threads may allow the attachment of a means to hold a utility routing. Non-limiting examples of the holding means may be a hook or a clamp to secure a pipe.

DETAILED DESCRIPTION

While the exemplary embodiments illustrated herein may show the various features, it will be understood that the features disclosed herein can be combined variously to achieve the objectives of the present invention.

The modular building panel hanging system of the present invention is designed to provide a means to attach items to building panels. Hanging, in this application, may mean attaching an item to a ceiling panel or a wall panel. However, this invention may also embrace embodiments wherein an item is secured to a floor panel. Items contemplated for the attachment to building can encompass any item a user desires to attach to a modular building. Non-limiting examples may include not only utility routings, such as water pipes, gas lines, electrical conduit, network cables, sewer lines, but also building fixtures, such as lighting, plumbing, mechanical equipment, cabinets, or other fixtures. Depending on the application, the hanging system may be constructed of metals, polymers, composites, wood, or other suitable material.

The modular building panel hanging system in this invention may have numerous different particular embodiments. One common theme to these embodiments can be: 1) a load distribution member that rests against the backside surface of a building panel, 2) a hanging structure that attaches to the load distribution member and extends through the building panel to the second side of the building panel, and 3) a hanging member at the end of the structure for attaching an item on the second side of the building panel.

For example, one possible embodiment can use the above structure to hang a pipe from a ceiling panel. The load distribution member can be a loading plate that rests flat against the top surface of the ceiling panel and distributes a hanging load onto the panel. The hanging structure may be a rod or stud that attaches to the underside of the loading plate and extends downward through a hole through the ceiling panel. The end of the rod or stud may extend downward past the underside surface of the ceiling panel. At the end of the rod may be an attachment means for securing a utility routing. This could either be a final securing means, such as a hook or clamp. Alternatively, the end of the rod may be a means for attaching another member, such as a threaded-end, snap-fit, a flange, or any other means for attaching one member to another. For example, the end may have threads, to which a pipe is attached.

Figure 1:
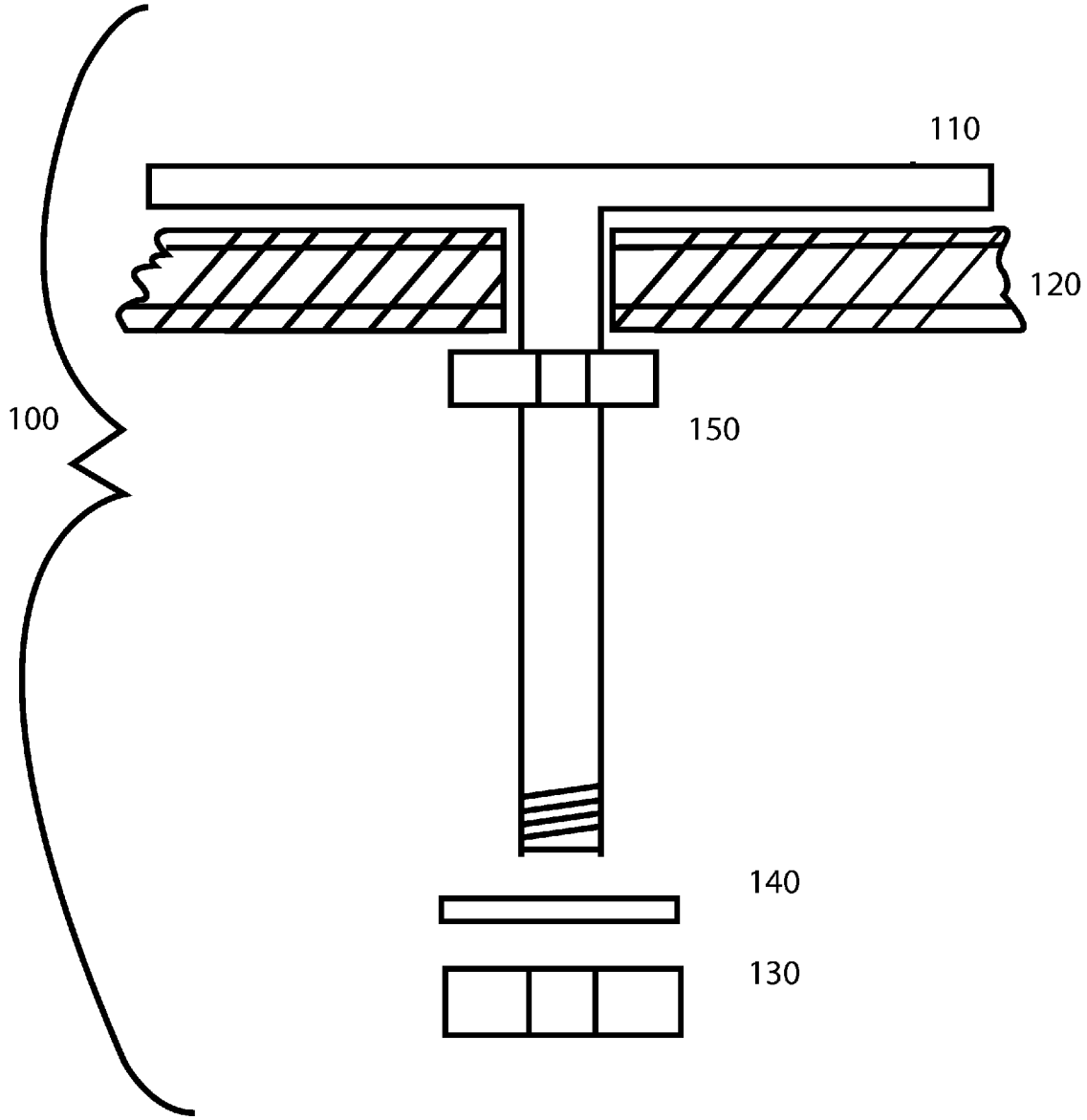
FIG. 1 shows a cross-sectional view of one embodiment of the modular building panel hanging system.

Turning to FIG. 1, the figure illustrates one embodiment of the hanger system, 100. The hanger 110 extends vertically through a roof panel 120. On the upper surface of the roof panel, the loading member at the top of the hanger 110 suspends the rod and distributes the load onto the top surface of the roof panel 120. The loading member can be a variety of shapes, including square or circular. The hanging rod runs downward from hanger 110 through a hole in the roof panel 120. At the bottom end of the hanging rod, which extends through the bottom of the roof panel, the rod is threaded. Along the rod, at a portion at the exit of the roof panel, an optional reducing coupling nut 150 can tighten the loading member of 110 against the panel 120 and secure it in place. Past the reducing coupling nut 150, the rod of the rod 110 extends further and allows at item to secure to the bottom of the rod with a threaded nut 130 and washer 140. However, a virtually limitless variety of attachments at the end of the attachment rod of 110 include: hangers, clamps, snap-fits, or male or female threaded ends. An optional feature on the hanger 110, are flats on the rod portion of 110, to hold it while the coupling nut is tightened. An additional loading plate could be fastened to both the backside and frontside of the panel 120 for some applications to avoid damage and increase load bearing capability of both sides of the roof panel under different load conditions. To facilitate the assembly, one of the loading plates could be threaded onto the rod 110.

Ideally, the size, diameter, shape, material, or thickness of the loading plate 110 could be specifically calculated to meet certain criteria. These criteria may be designed specifically to minimize various types of physical damage to the building panel 120, including deformation, fractures, indentation, and pull-through, as described above. For one non-limiting example, a 2-inch square loading plate 110 of 3/16 inch thickness is used to achieve a 1200 pound (psi) load capacity with a panel constructed of oriented strand board (OSB) with an expanded polystyrene (EPS) core with a high safety factor. The size of the hole in the building panel 120 is approximately 0.5 inches. One way of describing the size of the loading plate is the proportion of the loading plate 110 size to the hole size—in this case, 4 (2/0.5). Another way of describing might be the ratio of the size of the loading plate 110 to the thickness of the building panel 120. In the case of a round loading plate 110, the characteristic dimension can be the diameter. In the case of the square loading plate 110, the characteristic dimension can be the length or width or the square.

This size may provide high loading with approximately small amounts of physical damage to the building panel 120 material, if any. In particular, this calculation was performed with ½" to 7/16" plywood or OSB, which is typically used for these applications. With certain designs, the loading plate 110 may provide the hanging system 100 with load bearing capabilities greater than conventional designs, such as a system using a bare fastener head for load bearing. In addition, the design may also prevent delamination of the OSB/plywood layer from an EPS/insulation layer of the panel on the lower or upper surface. This is one unexpected result of the design described above. Therefore, the load profile across the surface of the building panel 120 has importance beyond simply whether the board fractures or not.

The surface of the load plate 110 could also be shaped, such as concave, to optimally distribute stress under loading. Additionally, the load plate of the hanger system could be wire mesh, radial fingers, or other non-conventional shape. Also, a wire mesh, plate, or other shape of the plate could be incorporated directly into the panel 120 itself. An example of this design would be a plate that is sandwiched and secured between two layers of the building panel when it is constructed. Then the attaching member or stud could be pre-attached to the loading plate, or attached after the construction of the panel.

In another optional embodiment of the disclosed system, a sealant could be used under the loading plate to limit any fluid or gas intrusions into the building. This could be any means for sealing, such as a gasket, caulk, or curing sealant. Optionally, a means for sealing could also be placed in the hole through the panel or at the surface where the stud exits the panel.

A similar design could also be used in walls or floors. As a non-limiting example, this could be done in cantilevered wall applications, where it is desired to protect and distribute loads on the backside of the panel 120, the frontside of the panel, and possibly to limit stress and enlargement around the hole or variously shaped opening in the wall.

Figure 2:
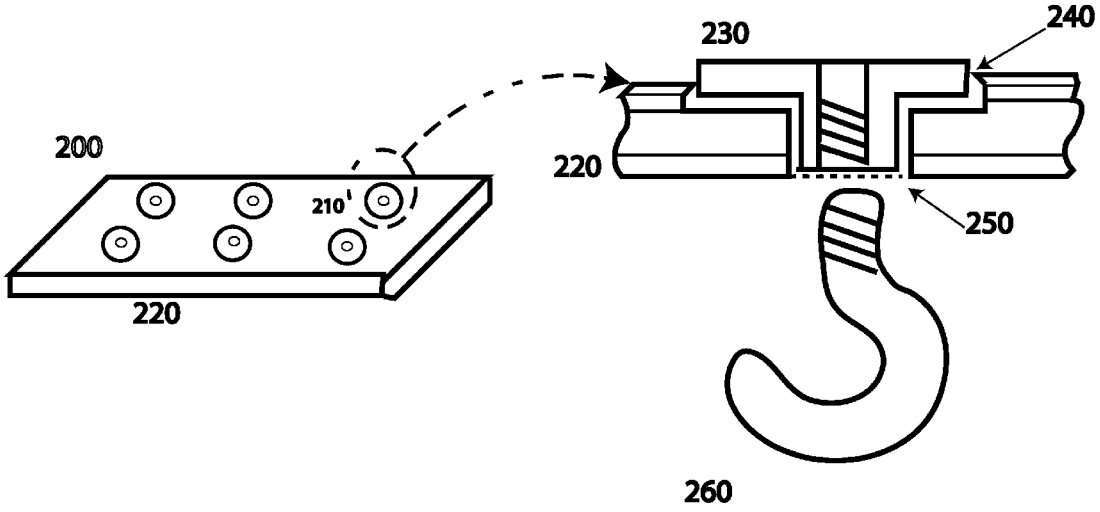
FIG. 2 shows another embodiment of a modular building panel hanging system, along with an exploded view in cross-section.

Turning to FIG. 2, this figure shows another embodiment of the hanging system, 200. This embodiment shows another optional feature wherein the hanger system is incorporated directly into an assembly with the building panel. For example, one or more load distribution hanging components 210 could be attached to the building panel 220 and ready to be used by the end user when he receives it. Here, the load distribution hanging components 210 could be pre-assembled into a plurality of standard positions in the panel, where the user can choose to variously use them, as his application requires. In an optional embodiment, the holes in the panel 220, and the load distribution hanging hangers 210, could be hidden, as shown by 250, until they are used, for a cleaner appearance. The could be hidden with tearable paper, plastering tape, stickers, or other means.

Alternatively, a number of hangers could be incorporated into the building panel in a number of standard positions, and prepared for use by the constructor. These hangers could be a shorter version of the system disclosed above, for aesthetic or convenience reasons. For example, it could be possible to incorporate a load plate on the backside of the building panel, have an attachment stud run through most or all of the panel thickness, then terminate the end of the stud with a threaded female nut end. These numerous nut locations could be variously activated by the constructor by threading a hook or other fastening end into the sites he wishes to use in his application. As stated above, the variations of the terminating end of the hanger is virtually limitless, and could be any reasonable means for attaching one member to another. The terminating end of the stud could also be any variation, as stated above. In another variation of this embodiment, the terminating end could be recessed into the building panel itself, such as into a spotface on the lower surface, and optionally covered or plugged for aesthetic purposes. Then the constructor could activate the various sites for his application while maintaining the finished appearance of any hanger sites not used. As an example, a matrix of evenly spaced attachment sites could be incorporated into all building panels to accommodate various applications.

The close-up view of FIG. 2 shows the load distribution plate 230 of a load distribution hanging component 210 that is resting in a hole of the building panel 220. In an optional embodiment, the load distribution plate 230 can be permanently attached to the panel 220, and can optionally sit in a spotfaced or recessed area 240 of the panel 220, for possibly better load bearing characteristics. The load distribution hanging component 220 can have an attachment means in it, such as a female threaded internal hole. Then, a desired attachment member 260 can be attached to the hanging component 220. This member 260 could be any of the various attachment ends described above, such as a hook, a threaded stud, pipe hanger, or others.

Figure 3:
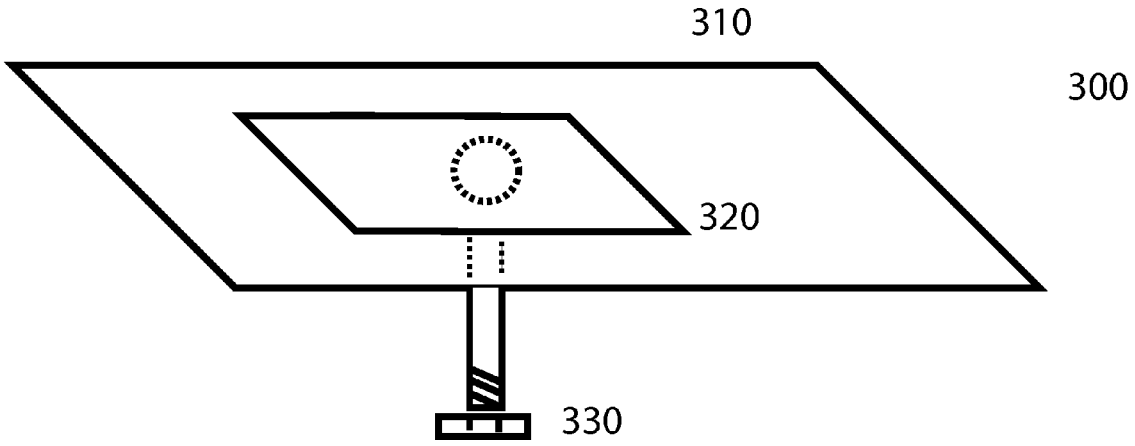
FIG. 3 shows an isometric view of another embodiment of the modular building panel hanging system.

Turning to FIG. 3, assembly 300 shows an isometric view of one embodiment of the building panel hanging system. Here, 310 is the building panel, and 320 is a square loading plate. The hanging attachment shaft 330 is attached to the loading plate 320 and extends downward through a hole in the building panel 310.

In another variation of the previous embodiment, the hanger system could be a series of moveable hanger sites to accommodate end-user positions. For example, the loading plate could be a longitudinal rail wherein the stud and attachment end could slide. Alternatively, a separate rail could be incorporated into the building panel, while the loading plate and attached stud both slide to different positions as an assembly. Again, this rail or track system could be recessed into the panel for aesthetic purposes, or could be partially or completely covered for aesthetic purposes. The ends could either be completed hangers or could be receptacles for user attachments, such as the female threaded nut, as described above. The rails could also incorporate motion in two directions along the surface.

Any combination of the above features and options could be combined into a wide variety of embodiments. It is, therefore, apparent that there is provided in accordance with the present disclosure, systems and methods for attaching items to a modular building panel system. While this invention has been described in conjunction with a number of embodiments, it is evident that many alternatives, modifications and variations would be or are apparent to those of ordinary skill in the applicable arts. Accordingly, applicants intend to embrace all such alternatives, modifications, equivalents and variations that are within the spirit and scope of this invention.

What is claimed is:

1. A modular building panel hanging system comprising:

a modular building panel, at least one hole in the modular building panel, at least one hanging member in the at least one hole in the building panel, the hanging member comprising:

a load distribution flange, a bushing extending perpendicularly from one side of the load distribution flange, the bushing residing in at least one hole in the building panel, and a hole extending at least part way through the center of the bushing; and a hanger, attached to the hanging member at the hole extending at least part way through the center of the bushing, wherein the hanger and the load distribution plate are each at the opposite distal ends of the bushing, and the modular building panel is between the hanger and the load distribution plate.

2. The modular building panel hanging system of claim 1, wherein the modular building panel is two layers of oriented strand board separated by expanded polystyrene.

3. The modular building panel hanging system of claim 1, further comprising a covering for the hanging member so that it is not visible until the hanger is desired to be attached to the hanging member.

4. The modular building panel hanging system of claim 1, wherein a plurality of hanging members in holes are distributed in various parts of the modular building panel.

5. The modular building panel hanging system of claim 1, wherein the modular building panel is a ceiling panel.

6. The modular building panel hanging system of claim 1, wherein the modular building panel is a wall panel.

7. The modular building panel hanging system of claim 1, further comprising a weighted member at the end of the hanger opposite to the load distribution flange.

* * * * *